United States Patent [19]

Stark

[11] 4,053,102

[45] Oct. 11, 1977

[54] REINFORCED PAPERBOARD CAN

[75] Inventor: Martin H. Stark, Saginaw, Mich.

[73] Assignee: Arrow Paper Products Company, Saginaw, Mich.

[21] Appl. No.: 724,465

[22] Filed: Sept. 17, 1976

[51] Int. Cl.[2] ..... B65D 5/02

[52] U.S. Cl. ..... 229/37 E; 229/14 BA

[58] Field of Search ..... 229/14 BA, 14 BN, 14 H, 229/DIG. 2, 37 E

[56] References Cited

U.S. PATENT DOCUMENTS

| | | | |
|---|---|---|---|
| 2,279,358 | 4/1942 | Waters | 229/14 BA |
| 2,710,134 | 6/1955 | Schroeder et al. | 229/DIG. 2 |

FOREIGN PATENT DOCUMENTS

| | | | |
|---|---|---|---|
| 534,925 | 2/1955 | Belgium | 229/DIG. 2 |
| 480,705 | 1/1952 | Canada | 229/14 BA |
| 832,372 | 4/1960 | United Kingdom | 229/14 BA |

*Primary Examiner*—Davis T. Moorhead

*Attorney, Agent, or Firm*—Learman & McCulloch

[57] ABSTRACT

A reinforced paperboard can is constructed from a pair of rectangular, superposed paperboard blanks each of which is transversely scored to form side and end walls of the can. Those panels of each blank which are to constitute the side walls are uniform in size and those panels which are to constitute the end walls also are uniform in area. Each of the blanks is scored longitudinally whereby flaps are formed along one edge of the panels of one blank and which are separated by slits so as to enable the flaps to form a bottom closure for the can. The other blank has a smaller area than the first blank so that the other blank has tabs of less area than the flaps and which are separated from one another by slits so as to enable the tabs to overlie the flaps. The can thus produced has double thickness side and end walls, and the closure flaps adjacent the side and end walls also are double thickness. A top closure for the can may be provided by flaps similar to the first mentioned flaps or by a separate top member which may be crimped to the side and end walls.

11 Claims, 6 Drawing Figures

REINFORCED PAPERBOARD CAN

This invention relates to a reinforced paperboard can of the kind that is especially adapted to contain dry bulk material such as chocolate or other fluent materials. Such cans conventionally have side and end walls formed of paperboard and top and bottom closures formed of metal which are crimped to the side and end walls of the can. The metal top and bottom closures have been deemed necessary heretofore to provide adequate reinforcement against rupture of the can due to slumping of its contents and rough handling. Although the use of top and bottom metal closures provides reinforcement of a can's side and end walls adjacent their upper and lower edges, they provide little or no reinforcement to the intermediate portions of the side and end walls. In addition, the manufacture of cans having crimped top and bottom metal closures is considerably more expensive than the manufacture of an all paperboard can.

A can constructed according to the invention may be all paperboard or all paperboard except for an upper closure. In either case, the side and end walls of the can are reinforced by double thickness paperboard and the edges of the can are similarly reinforced to enable the can to withstand rough handling such as that encountered in the filling, transport, and use of the can.

Means for constructing cans according to the invention is disclosed in the accompanying drawings wherein.

Figure 1:
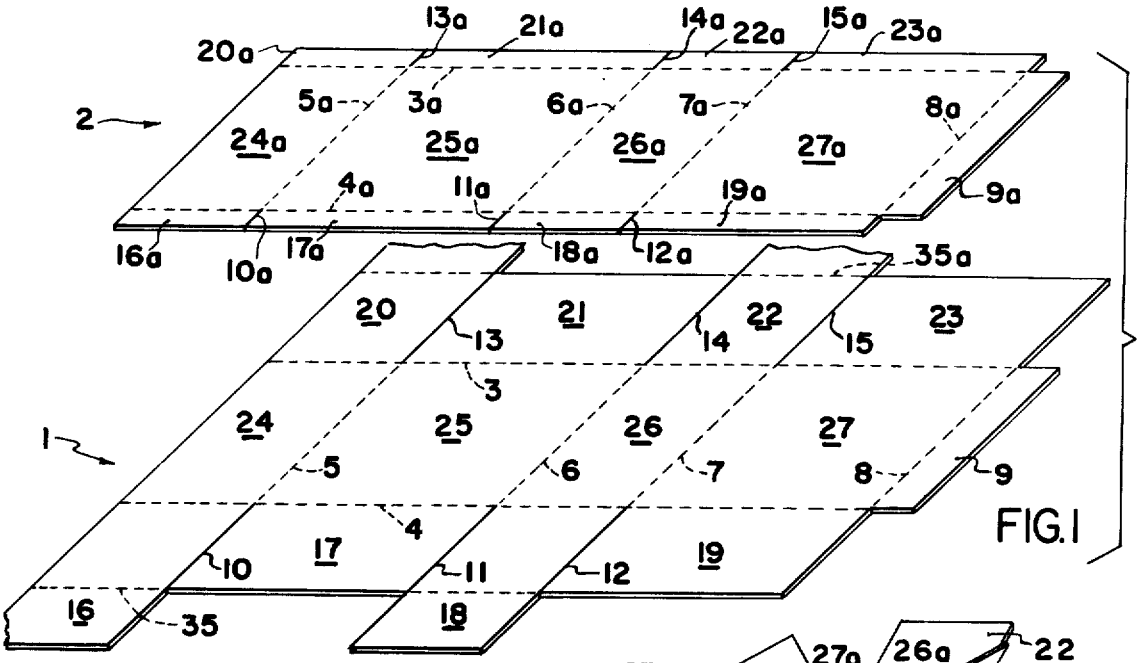
FIG. 1 is an exploded, isometric view of two blanks from which the can according to one embodiment of the invention is made.
Figure 2:
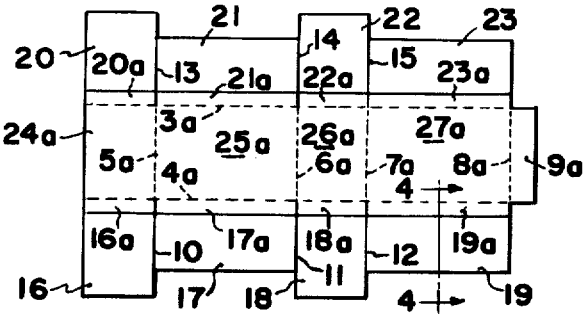
FIG. 2 is a top plan view showing the two blanks in superposed relation.
Figure 3:
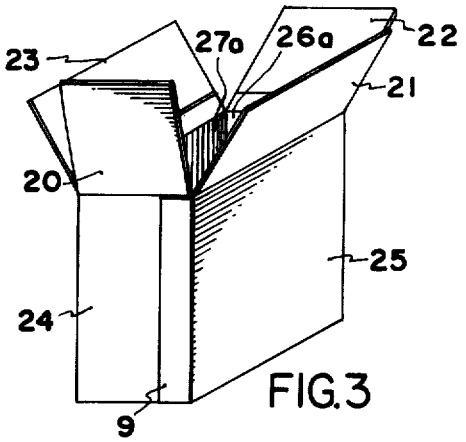
FIG. 3 is an isometric view of an assembled can.

A can constructed according to the embodiment of FIGS. 1–4 is illustrated in FIG. 3 and is formed from two paperboard blanks 1 and 2. The paperboard from which the blanks are formed may be uniform kraft board or the like. The blank 1 has an area larger than that of the blank 2 and comprises a rectangular piece of paperboard scored longitudinally from end to end on parallel lines 3 and 4 and transversely from edge to edge along parallel lines 5, 6, 7, and 8. A tongue 9 projects from the right-hand end of the blank 1. Outboard of the score lines 3 and 4 the blank is slit along the lines 10–15, thereby providing coextensive flaps 16–23. The score lines 3–8 provide a plurality of panels 24, 25, 26, and 27, the panels 24 and 26 being of uniform area and the panels 25 and 27 being of uniform area. Each of the flaps 17, 19, 21, and 23 is of uniform area and extends the same distance from the respective score lines 4 and 3 as do the associated panels 25 and 27. The other flaps extend from the score lines a distance corresponding to the longitudinal dimension of the panels 24 and 26.

When the blank 1 is folded along the score lines 5–8, the panels 24 and 26 provide opposed side walls of a can and the panels 25 and 27 form opposed end walls of a can. The flaps 16–23 may be folded along the respective score lines 4 and 3 so as to form closures for the top and bottom of the can. The flaps 17, 19, 21, and 23 span the distance between the can end walls, whereas the flaps 16, 18, 20, and 22 span the distance between the can end walls.

The blank 2 has score lines and panels identified by reference numerals corresponding to those used in connection with the blank 1, but followed by the suffix *a*. Instead of having flaps like the flaps 16–23, however, the blank 2 has coextensive tabs 16*a*–23*a* which are of less area than that of the flaps. The tabs 16*a*–23*a* are separated from one another by slits 10*a*–15*a* similar to the slits 10–15. Although the overall area of the blank 2 is less than that of the blank 1, the panels 24*a*–27*a* correspond to the size of the panels 24–27, respectively, and the area of the tongue 9*a* corresponds to the area of the tongue 9. Due to the smaller area of the tabs, 16*a*–23*a*, they project a shorter distance beyond the respective score lines 4*a*, 3*a* than do the flaps of the blank 1.

Following the formation of the blanks 1 and 2, the blank 2 is placed in overlying relation with the blank 1 and is bonded adhesively thereto.

In their superposed relation, the blanks are so arranged that the score line 3*a* directly overlies the score line 3, the score line 4*a* directly overlies the score line 4, and the score lines 5*a*, 6*a*, and 7*a* directly overlie the score lines 5, 6 and 7, respectively. Accordingly, the panels 24–27 will be in register with the panels 24*a*–27*a*, respectively, the tongues 9 and 9*a* will be in register, and the tabs 16*a*–23*a* will overlie those portions of the respective flaps 16–23 adjacent the associated panels.

When the superposed and adhered blanks are folded along their score lines, the panels 24,. 24*a* and 26, 26*a* will form opposed, double thickness side walls of a can, the panels 25, 25*a* and 27, 27*a* will form opposed, double thickness end walls for the can, the flaps 16–19 will form a four-thickness bottom closure for the can, and the flaps 20–23 will form a four-thickness top closure for the can. The tabs 16*a*–23*a*, being fixed to their respective flaps 16–23, will not be coplanar, but instead will occupy different planes. Thus, the terminal ends of the tabs 16*a*–23*a* will overlap one another to provide reinforcements at the corners of the can. The intermediate portions of the tabs 16*a*–19*a* span the bottom closure flaps 16–19 adjacent the bottom edge of the can, thereby reinforcing the bottom edge, and the tabs 20*a*–23*a* reinforce the top closure flaps 20–23 adjacent the upper edge of the carton. The bottom closure flaps 16–19 may be adhesively secured to one another and the tongues 9, 9*a* may be adhesively secured to one another and either to the inside or the outside surface of a side wall 24 so as to maintain the can in the erected condition.

Following filling of the can the top closure flaps 20–23 may be folded over one another and adhesively secured to seal the can.

Figure 4:
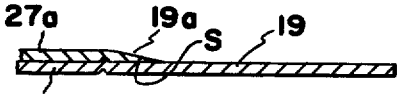
FIG. 4 is a greatly enlarged sectional view taken on the line 4—4 of FIG. 2.

It is preferred that the free edges of the tabs 16*a*–23*a* be skived as is indicated at S in FIG. 4, thereby reducing the thickness of the free edges of such parts.

Figure 5:
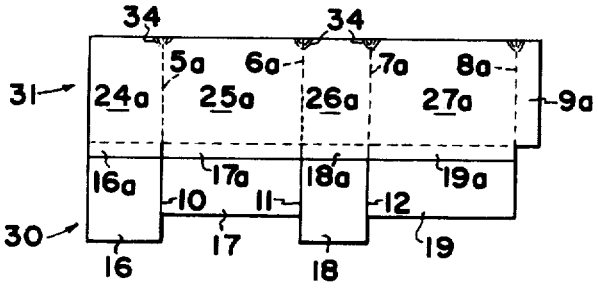
FIG. 5 is a view similar to FIG. 2, but illustrating a modified embodiment.

The structure shown in FIG. 5 comprises two superposed blanks 30 and 31. The blank 30 corresponds to the blank 1 with the exception that the top closure flaps are omitted and the blank 31 corresponds to the blank 2 with the exception that the top closure reinforcing tabs are omitted. Except for these changes the blanks 30 and 31 correspond exactly to the blanks 1 and 2, respectively, and, accordingly, similar reference characters are used to designate similar parts.

Figure 6:
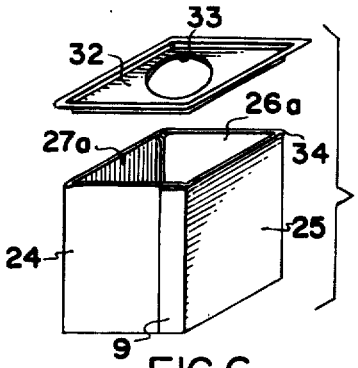
FIG. 6 is an isometric view of a can constructed from the apparatus shown in FIG. 5.

A can constructed from the structure shown in FIG. 5 is illustrated in FIG. 6.

The can disclosed in FIG. 6 is the same as that disclosed in FIG. 3 with the exception that the can of FIG. 6 has no top closure flaps. A closure for the can of FIG. 6 comprises a rectangular metal plate 32 the marginal edges of which may be crimped in known manner to the upper edges of the can's side and end walls. The metal member 32 has an opening 33 therein which may be closed by a removable cap (not shown).

When a can is to be fitted with a metal closure, it is desirable to round the corners of the can to facilitate the crimping or clinching of the closure to the can body. Rounding of the corners may be effected by the provision of outwardly diverging score lines 34 at the juncture of adjacent side and end walls.

It is not essential that the flaps 16, 18, 20, 22, of the blank 1 or 30 and the companion flaps of the blanks of FIG. 2 be capable of spanning the distance between the end walls of the can. The free edges of such flaps could terminate flush with the free edges of the adjacent flaps, as indicated by dotted lines 35, 35*a* in FIG. 1, in which event the free edges of the flaps 16, 18, 20, and 22 will overlap or abut their confronting flaps.

The disclosed embodiments are illustrative of presently preferred forms of the invention, but are intended to be illustrative rather than definitive thereof. The invention is defined in the claims.

I claim:

1. Structure for forming a reinforced paperboard can comprising a first rectangular paperboard blank scored transversely to form a plurality of side-by-side panels and scored longitudinally to form a plurality of coextensive flaps at least along one edge of said panels, each of said flaps being separated from the adjacent flap by a slit; a second rectangular paperboard blank having a length corresponding to the length of said first blank and a width less than that of said first blank, said blanks being of substantially uniform thickness, said second blank being scored transversely to form a plurality of side-by-side panels corresponding in number and area to the number and area of the panels of said first blank and being scored longitudinally to form a plurality of coextensive tabs at least along one edge of the panels of said second blank, each of said tabs being separated from the adjacent tab, said first and second blanks being superposed with their respective panels, flaps and tabs in overlying relation and the panels in register with one another; and means securing said blanks to one another.

2. Structure according to claim 1 wherein said first blank has a plurality of said flaps extending along that edge of the panels of said first blank which is opposite said one edge.

3. Structure according to claim 2 wherein said second blank has a plurality of said tabs overlying the flaps extending along said opposite edge of said first blank.

4. Structure according to claim 1 wherein each of said tabs has a free edge, each of said free edges being skived.

5. Structure according to claim 1 wherein alternate ones of said panels of said first blank and alternate ones of said flaps extend a uniform distance on opposite sides of and away from the longitudinal score.

6. Structure according to claim 1 wherein alternate ones of the flaps of said first blank extend a greater distance from the associated score line than do the adjacent flaps.

7. Structure according to claim 1 wherein all of the flaps of said first blank have free edges flush with each other.

8. Structure according to claim 1 wherein said first blank has coextensive flaps along both edges of said panels.

9. Structure according to claim 8 wherein said second blank has tabs overlying and secured to the subjacent flaps.

10. Structure according to claim 1 wherein the panels of said first blank are scored adjacent their juncture with one another.

11. Structure according to claim 10 wherein said panels of said first blank are scored only at the edge thereof opposite said one edge thereof and along inwardly converging lines.

* * * * *